United States Patent [19]

Candor et al.

[11] 4,040,229

[45] * Aug. 9, 1977

[54] METHOD OF MAKING A PACKAGE CONSTRUCTION FOR BASEBALL TYPE PLAYING COMPONENTS

[76] Inventors: James T. Candor, 5440 Cynthia Lane, Dayton, Ohio 45429; Joseph V. Tassone, 2425 Rawnsdale Road, Kettering, Ohio 45440

[ * ] Notice: The portion of the term of this patent subsequent to Apr. 27, 1993, has been disclaimed.

[21] Appl. No.: 658,102

[22] Filed: Feb. 17, 1976

Related U.S. Application Data

[60] Division of Ser. No. 481,776, June 21, 1974, Pat. No. 3,952,477, which is a continuation-in-part of Ser. No. 326,805, Jan. 26, 1973, Pat. No. 3,830,362, and a continuation-in-part of Ser. No. 320,206, Jan. 2, 1973, Pat. No. 3,819,038.

[51] Int. Cl.[2] ..... B65B 5/04

[52] U.S. Cl. ..... 53/29; 273/26 R; 53/35

[58] Field of Search ..... 273/26 R, 26 E, 95 A; 43/11, 32; 53/3

[56] References Cited

U.S. PATENT DOCUMENTS 2,527,906 10/1950 Bennett et al. ..... 273/26 R

FOREIGN PATENT DOCUMENTS 808,143 6/1956 United Kingdom ..... 273/26 R

*Primary Examiner*—Anton O. Oechsle
*Assistant Examiner*—T. Brown
*Attorney, Agent, or Firm*—Candor, Candor & Tassone

[57] ABSTRACT

A method of making a package construction for baseball type playing components is provided which comprises a ball tee member and ball bat telescoped within the tee member and may include one or more balls.

10 Claims, 25 Drawing Figures

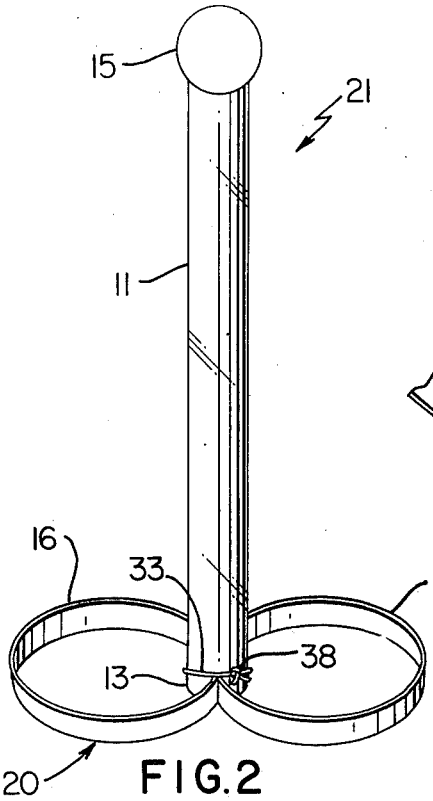
FIG.2
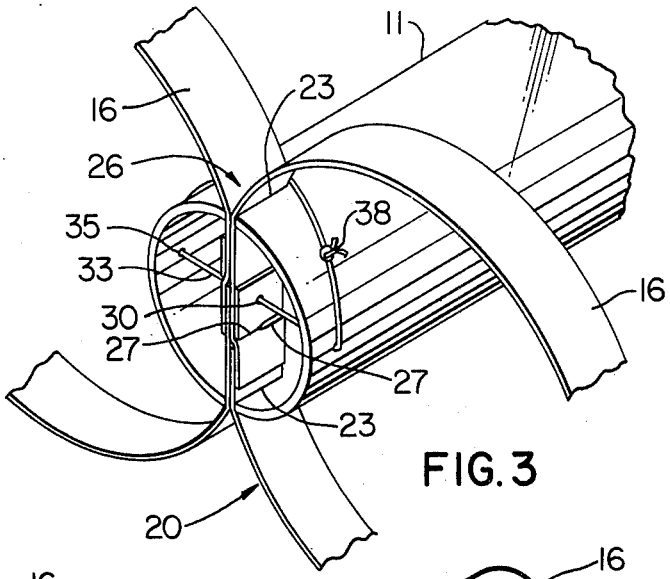
FIG.3
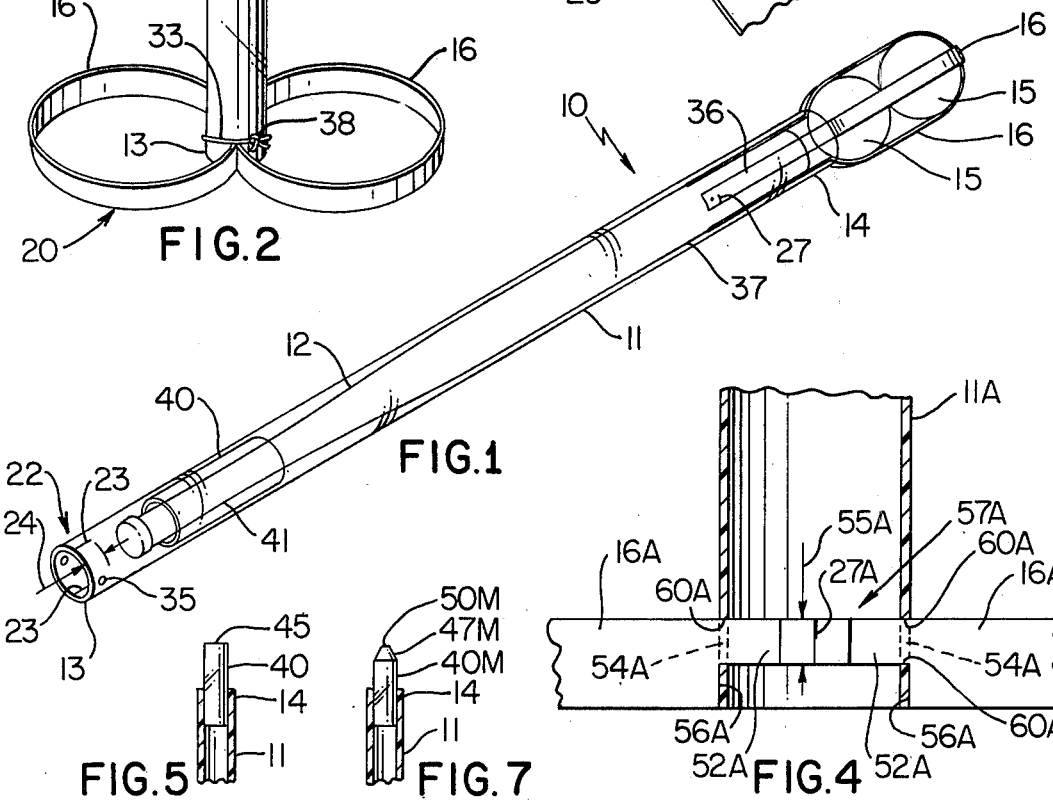
FIG.1
FIG.4
FIG.5
FIG.7
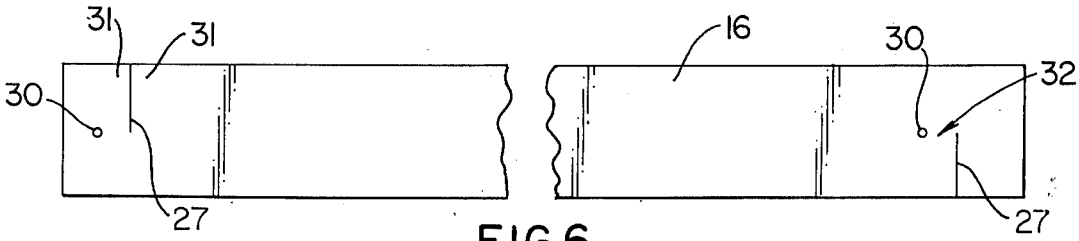
FIG.6

20J
21J
70J
68J
67J
23J
72J
71J
24J
B
22J
29J
27J
20
28J
20

20K
90K
21K
23K
24K
22K

22J
B
72J

20KA
23KA
93KA
B

B
83J
21J
23J
70J 75J
22J
73J
29J
74J
81J
23J
82J
81J
22J
80J
23J
78J
77J 20J
85J
20J
86J
84J

METHOD OF MAKING A PACKAGE CONSTRUCTION FOR BASEBALL TYPE PLAYING COMPONENTS

CROSS REFERENCE TO RELATED APPLICATIONS

This is a division of application Ser. No. 481,776, filed June 21, 1974, (now U.S. Pat. No. 3,952,477), which is a continuation-in-part of application Ser. No. 326,805, filed Jan. 26, 1973 (now U.S. Pat. No. 3,830,362); and a continuation-in-part of application Ser. No. 320,206, filed Jan. 2, 1973 (now U.S. Pat. No. 3,819,038).

BACKGROUND OF THE INVENTION

The popularity of ball games such as baseball, softball, and the like, is well known; however, particularly with young children starting at roughly age 4, it is difficult to play these ball games because a pitcher and a catcher are required. At the above-mentioned age and even with some children as old as roughly 10 years of age, it is dangerous to have a catcher stand too close to a young batter swinging a bat because of the poor control which such batter has over the bat. Further, particularly in baseball, young pitchers do not have the ability or physical strength to consistently pitch a ball across home plate to assure that the game will progress at reasonable speed. In addition, with the increased number of arm injuries in recent years, such as so-called "Little League elbow," it is desirable to reduce the pitching stress on the arms of young children.

Therefore, a modified form of baseball, popularly referred to as "tee ball", has been introduced for young children and has had remarkable success. As the name suggests, the game is played with a ball supported on a tee and struck with a bat while the tee is placed on home plate of a regular ball diamond. The ball is usually supported at about waist height to enable the batter to make easy contact with the ball with a smooth, even swing.

With this arrangement the pitcher is not required to pitch the ball and in actual play is required to keep one foot on the pitching rubber until a batter hits the ball, whereupon he may move away from the rubber to field the ball or otherwise assist in defensive play. Similarly, the catcher is required to stand a considerable distance away from the tee on home plate (and a swinging bat) where he is less likely to be injured by the batter. Once the ball is hit, the catcher assumes the normal defensive role of a catcher.

Generally the basic rules which govern play in major league baseball, as played in the United States, apply to tee ball, with modifications such as mentioned above to enable use of a tee. In addition, for young boys the bases are usually 60 feet apart in the usual diamond pattern and the pitcher's rubber is 45 feet from home plate.

In most instances the infield positions are the same as played by major league baseball teams; however, the outfield positions may vary in number from the usual 3 to as many as 5, where it is desired to allow participation by more players. Also, to prevent a particular team from remaining at bat too long, limitations are usually placed as to the number of batters that may bat in a given inning and this number is usually the number of players on the team. Thus, with teams of eleven players each, once the eleventh player comes to bat and regardless of the number of outs prior to that time, after the ball is in play as the result of the eleventh batter's action, all action and scoring are stopped merely by playing the ball home and tagging home plate.

Tee ball games may vary in length to suit local situations, however, they are usually six innings in length, and a complete six inning game with the home team batting in the sixth may be completed usually within roughly one and one-half hours.

It will be appreciated that in order for tee ball to be successful it is necessary to have a tee that a young batter will not be afraid to hit with a regular baseball bat because it might sting his hands. In addition, it is desirable that the tee be such that it supports the ball at a height, in the strike zone, where it may be easily hit with a level swing.

It is generally quite difficult for a young ball player to improve his batting skills for back yard play, tee ball, or regulation baseball and softball while playing alone and various comparatively expensive ball toss-up devices, rotating devices each having a simulated ball thereon, and stationary tee devices have been proposed heretofore. These previously proposed ball toss-up devices are for the most part unsatisfactory because they do not permit a young batter to assume a correct initial stance nor is it possible to teach a young player to move into the ball in the desired manner while swinging a ball bat. The rotating devices are very complicated, require expensive anchoring means, and are probably not too safe for the very young ball player.

Many of the prevously proposed stationary tees are categorically unsafe and should not be used. Others of such tees, though comparatively safer, are too expensive.

Because young ball players practically universally do not take proper care of their equipment, it would be desirable to provide an inexpensive method of making a package construction and hence a resulting package which may include a ball bat, a ball tee, and one or more balls which would allow a young batter to improve his or her batting skills yet is so economical that even if abused, damaged, or lost could be replaced at minimum cost.

SUMMARY

This invention provides an economical package construction and method of making same which includes a ball tee member, a bat, and may include one or more balls and such package is self contained and all parts thereof are useable so that a purchaser is paying for useable components and not packaging material.

Other details, uses, and advantages of this invention will be readily apparent from the exemplary embodiments thereof presented in the following specification, claims, and drawing.

BRIEF DESCRIPTION OF THE DRAWING

The accompanying drawing shows present preferred embodiments of this invention, in which FIG. 1 is a perspective view illustrating one exemplary embodiment of the package construction of this invention;

FIG. 2 is a perspective view illustrating components of the package construction of FIG. 1 suitably assembled together to define a ball tee member and showing a ball comprising such package construction supported on an annular surface provided at the top of the ball tee member;

FIG. 3 is an enlarged fragmentary perspective view illustrating the manner in which the base of the ball tee member of FIG. 2 is assembled;

FIG. 4 is a fragmentary view with parts in cross section and parts broken away illustrating another exemplary embodiment of a tubular ball tee member and modified strap means or straps which may comprise a package construction similar to the package construction of FIG. 1;

FIG. 5 is a fragmentary view illustrating a smaller diameter tubular member which is provided as a part of the package construction of FIG. 1 being used as a vertically slidable member at the top of the tee to define an annular ball-supporting surface which is adjustable to an infinite number of vertical heights;

FIG. 6 is a plan view with the central portion thereof broken away of a strap means comprising the package of FIG. 1 and used in the package for detachably securing one or more balls in the package construction yet defining the base of the tee made from such package;

FIG. 7 is a fragmentary view similar to FIG. 5 illustrating another exemplary embodiment of a smaller diameter tubular member which may comprise the package construction of FIG. 1;

FIG. 19 is a view in elevation illustrating another exemplary embodiment of the package construction of this invention and method of making same comprised of a ball tee member made of a transparent material and having an integral base and being provided with a ball bat telescoped within the ball tee member and a plurality of balls disposed in the base of the ball tee member;

FIG. 20 is a view taken essentially on the line 20—20 of FIG. 19.;

FIG. 21 is a view illustrating the ball tee member of FIG. 19 with the balls and bat removed from therewithin and illustrating one of the balls supported thereon for hitting with a ball bat while illustrating the closure member of the package construction installed in position at the base thereof while containing ballast means in the form of sand, dirt, or the like;

FIG. 22 is a perspective view with certain parts broken away particularly illustrating the method of making the ball member of the package construction of this invention;

FIG. 23 is a view illustrating the manner in which a plurality of package constructions may be packaged in a carton for shipping and the like and showing the upper portion of the carton severed away enabling such carton to be used as a display carton;

FIG. 24 is a view illustrating another exemplary embodiment of the package construction of this invention comprised of a ball tee member and a ball bat; and FIG. 25 is a view illustrating still another exemplary embodiment of the package construction of this invention and method for making same illustrating a ball tee member, a ball bat, and a ball of such package construction.

DESCRIPTION OF ILLUSTRATED EMBODIMENTS

Figure 8:
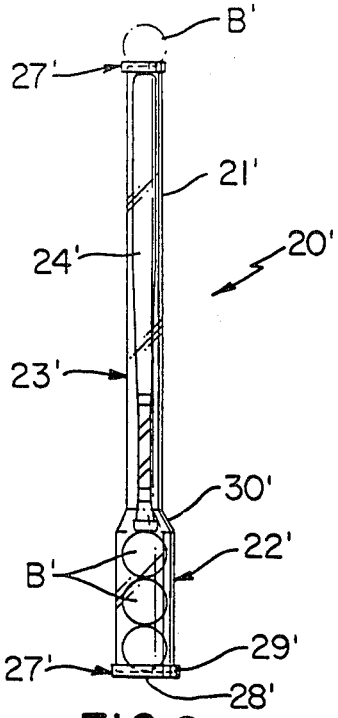
FIG. 8 is a view in elevation illustrating another exemplary embodiment of the package construction of this invention comprised of a ball tee member made of a transparent material and having an integral base and being provided with a ball bat in telescoped relation within the ball tee member and a plurality of balls disposed within the base of the ball tee member.
Figure 9:
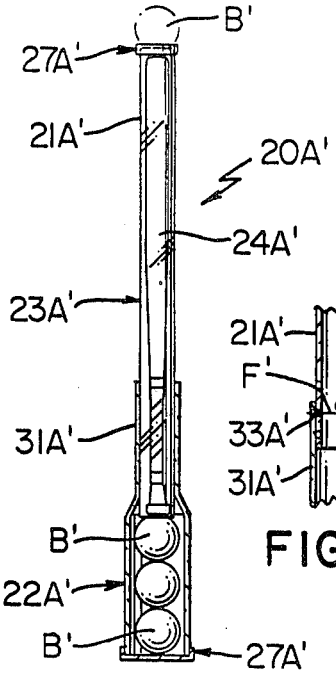
FIG. 9 is a view illustrating another exemplary embodiment of a package construction of this invention comprising base means, a ball tee member telescoped within the base means and made of a transparent material, a plurality of balls within the base means, and a ball bat inserted in telescoped relation within the ball tee member.

Reference is now made to FIG. 1 of the drawing which illustrates one exemplary embodiment of a package construction of this invention which is designated generally by the reference numeral 10. The package construction 10 comprises an outer tubular ball tee member 11 which is illustrated as being made of a transparent plastic material and the tubular member 11 has a bat 12 for hitting a ball off of the tee member 11 carried in telescoped relation within the member 11 and the maximum outside diameter of the bat and inside diameter of the tubular member 11 are such that the bat may be easily inserted within the tubular member 11.

The tubular member 11 has opposed ends 13 and 14 and at least one ball 15 and in this example a plurality of two balls 15 are provided adjacent its end 14 in aligned relation therewith. Means in the form of a pair of elongated strap means or straps 16 are provided as a part of the package construction 10 and are used for detachably securing the balls 15 to the end 14 of the tubular member 11. The securing means or straps 16 serve not only as a means for holding the balls 15 in position at the end of the transparent tubular member 11 but also are useable to form a base means or base designated generally by the reference numeral 20 in FIG. 2 for an overall tee 21 made using various components of the package construction 10.

The tubular member 11 has means 22 at one of its ends, shown as end 13 in this example, for receiving the strap means or straps 16 so that such straps 16 when forming the base 20 of the tee 21 will extend outwardly from the tubular member 11 and assure that the tubular member 11 will be disposed in its upright manner. The means 22 in the tubular member 11 may be slit means 23 defined simply as a pair of diametrically arranged rectilinear slits or cuts 23 or such slit means may be a pair of diametrically arranged slits 23 having a small width for receiving a double thickness defined by two straps, see FIG. 3. In applications where slits are used it is necessary to wedge each strap in position and the wedging action helps hold the strap in place. Each slit means 23 has a height indicated at 24 which corresponds to the width or what may also be considered the height of the straps 16 as illustrated at 26 in FIG. 3, whereby the bottom edges of the installed straps 16 are roughly coplanar with end 13 or in a plane outwardly thereof. Each strap 16 has slit means which may be a slit 27 at each end thereof and an opening 30 adjacent each slit. Each strap 16 is formed into a substantially circular configuration and the slits 27 moved past each other so that strap portions 31 on opposite sides of one slit 27 engage an associated area 32 of the strap 16 which is located inwardly of the other slit 27 while simultaneously the openings 30 are arranged in aligned relation. The two straps 16 in circular form are then positioned within the slit means 27 to define a looped configuration having substantially the form of a FIG. 8, and as will be apparent from FIG. 2 of the drawing. The two straps have their openings 30 arranged in aligned relation within the tubular member 11 as shown in FIG. 3 and a tie member or string 33 may extend therethrough and through diametrically opposed openings 35 in member 11 and has its ends tied in a knot 38 to help hold the base 20 in position at the bottom of the tubular member 11.

In the package construction 10 the straps 16 are arranged perpendicular to each other, looped around the two balls 15 of such package construction, and the terminal end portions 36 of such straps 16 are inserted within the tubular member 11 as illustrated at 36. The bat 12 is inserted in telescoped relation within the tubular member 11 and the outside diameter of the bat 12 at its hitting end portion 37 and the inside diameter of the tubular member 11 are such that the strap portions 36 are sandwiched therebetween and hold the straps 16, balls 15, and bat 12 in position without requiring other fasteners. However, it will be appreciated that the straps 16 may have their end portions 36 arranged externally of the tubular member 11 and in this latter instance, the fastening string 33 may be employed to tie the straps 16 against the outside surface of member 11 with the balls 15 in position or a suitable adhesive tape, or other fastening material may be employed for this purpose.

In some instances where an adjustable height tee is preferred it may be desirable to provide a tubular member 40 which may also be made of a transparent material and member 40 is carried within the tubular member 11. The member 40 is dimensioned so that it telescopes concentrically around the outside of the handle portion 41 of the bat 12 and telescopes concentrically within the tubular member 11 and the manner in which the tubular member 40 is used will be described in detail subsequently.

All component parts to the package construction 10 are readily useable whereby a user is not purchasing packaging materials as is the usual case. The user of the package construction 10 merely pulls the balls 15 and straps 16 away from one end portion of the tubular member 11 and removes the bat and tubular member 40. The straps 16 are then looped into circular configurations, arranged within slits 23 with their openings 30 in aligned relation, and tied in position with the fastening string 33 as described earlier whereupon the base 20 of tee 21 is defined. The tee 21 may then be supported on its base and a ball 15 supported on the annular surface provided at end 14 and hit in the usual manner.

As previously suggested, a tee which is adjustable in height may be desirable in some instances and for this purpose member 40 is provided. The tubular member 40 is inserted in telescoped relation within the end portion 14 of the tubular member 11 and the dimensions of the tubular members 11 and 40 are such that member 40 is frictionally held in position in any desired vertical position as shown in FIG. 5 and may be substantially infinitely adjustable over a height wherein the top annular surface 45 of member 40 is flush with end 14 to a maximum height position where member 40 extends above the top end 14 and with only a minimum overlap between members 11 and 40 with such minimum overlap being sufficient to assure the members are held in position even though the top of the tee 21 is repeatedly hit with a ball bat.

Thus, by utilizing the tubular member 40 the same basic tee may be used by ball players of different heights and where these ball players desire to precisely position the ball 15 for easier hitting.

As previously indicated the members 11 and 40 may be made of a transparent material and by making such members of a transparent material a ball 15 is supported on tee 21 appears to be suspended in mid air whereby a batter may hit such ball with minimum distraction by the tee. However, it will be appreciated that it is not necessary that the tubular member 11 and/or member 40 be made of a transparent material but such members may be made of any suitable material includng opaque or nontransparent materials.

Further, it will be appreciated that the components 11, 40 and 16 may be made of any suitable material and are preferably made of nonmetallic materials such as paper, elastomeric materials such as natural or synthetic rubber and plastic materials, etc.

The material used to make the straps 16 is such that when they are formed in their circular configurations and the tee 21 made using straps 16 is knocked over the circular straps will readily collapse or flatten when a person falls thereon whereby injury to such person is prevented. Once the flattened strap is released it will return to its original circular configuration. In addition, it is also preferred that the tubular members 11 and 40 be readily compressible or collapsible and resilient in character so that the person falling thereon will not be injured and once the weight of the person is removed the members 11 and 40 will return to their original configurations.

The package construction 10 lends itself to packaging of lightweight tee-defining components, lightweight plastic bats, lightweight balls and the like. In addition, such package construction lends itself to the packaging of regulation ball bats and regulation balls whether softballs, baseballs and the like.

Further, as an incentive to purchase a regulation bat, for example, and one or more balls, a manufacturer could (due to the minimal costs involved) offer the tee defining components 11, 16 and 40 free of charge.

In those applications where the tubular member 11 is made of a transparent plastic material and having properties as described above a regulation ball bat, such as a metal bat, may be viewed by a potential purchaser, yet such bat is protected against scratches, nicks, etc.

Reference is now made to FIG. 7 of the drawing which illustrates a modified version of the tubular member 40 which is designated generally by the reference numeral 40M and may be used interchangeably with the member 40 to provide a tee of adjustable height. The member 40M may be made of any suitable material including transparent plastic materials, or the like, and such member has a substantially frustoconical upper portion 47M which defines a reduced diameter annular ball-supporting surface 50M. The reduced diameter surface 50M is particularly adapted to support a ball which may be a regulation ball such as a baseball, a comparatively small diameter lightweight ball, a sponge rubber ball, or the like, so that the ball may be easily hit with a ball bat because the reduced diameter annular surface 50M assures that the ball is not nested too far within the tubular member 40M.

The member 40M may be telescoped within the tubular member 11 in a similar manner as the tubular member 40 and with its frustoconical portion 47M arranged outwardly so that once an associated package construction 10 has the balls 15 and straps 16 fastened in position adjacent end 14 and the member 40M fastened in position adjacent end 13 the bat 12 comprising such a package construction is effectively retained within the tubular member 11.

It will also be appreciated that in applications where a tubular member such as member 40 or 40M is not provided as a component of the package construction 10 the tubular member 11 may be provided with a frustoconical portion such as frustoconical portion 47M to define a reduced diameter annular surface which is particularly adapted to support a comparatively small diameter ball thereon in a non-nesting relation. In those applications where a tubular member 11 is provided with a reduced diameter end portion such as a frustoconical end portion the reduced diameter portion would preferably define the end 14 and the balls 15 and straps 16 would be provided at the end 13 of member 11 whereby a bat 12 within member 11 would be confined against axial movement and effectively retained within tubular member 11.

In the above description reference has been made to the utilization of a substantially frustoconical terminal end portion for either member 40M or tubular member 11 to provide ball-supporting means which would support a ball on the tee in a non-nested relation to assure easier hitting thereof. However, it will be appreciated that any suitable means may be provided for this purpose.

The straps 16 of the package construction 10 are shown held in position to define the base of the tee 21 using the string 33; however, it will be appreciated that by modifying the tubular member 11 and straps a string or similar fastener need not necessarily be provided. In particular, a reference is made to FIG. 4 of the drawing which illustrates a tubular member 11A which may be used interchangeably with member 11 together with straps 16A which are used with member 11A. The straps 16A have reduced width or height end portions 52A which are provided with slits 27A similar to the slits 27 previously described and the slits 27A function in a similar manner.

The tubular member 11A has diametrically opposed roughly rectangular slots 54A which have a height corresponding to the height 55A of the reduced height portions. Each strap has a shoulder 56A at the base of each portion 52A which limits movement of portion 52A within the tubular member the portions 52A are dimensioned based on the diameter of the tubular member 11A and the position of slits 27A similarly dimensioned so that the end portions 52A may extend through slots 52A and such portions interlocked using slits 27A as shown at 57A. Thus, each of the two strap members 16A extending through the two opposed slots 54A is prevented from coming apart by the interlocking made possible by its slits 27A and each interlocked strip 16A is held at the base of member 11A by the opposed top and bottom edges 60A of the slots 54A. The two strap members 16A are thus also arranged in a substantially figure 8 configuration.

Reference is now made to FIG. 8 of the drawing which illustrates one exemplary embodiment of a package construction of this invention which is designated generally by the reference numberal 28'. The package construction 20' comprises a ball tee member 21' which is adapted to have a ball B' hit off of same by a ball bat or the like and the ball tee member 21' has base means in the form of a base 22' defined as an integral part thereof to define what would be referred to as a ball tee and designated generally by the reference numeral 23'. The ball tee member or portion 21' of tee 23' and its base 22'are shown, in this example, as being made of a transparent material which is preferably a transparent elastomeric material such as plastic and member 21' is particularly adapted to be struck repeatedly by a ball bat, or the like, without substantial damage thereto whereby the tee 23' may be used for extended periods of time for both hitting practice either indoors or outdoors as well as for actual play of the game of tee ball which is rapidly increasing in popularity.

The package construction 20' has a ball bat 24' telescoped within its tee member 21' and a plurality of balls B' are provided and carried within the base 22' whereby such base also serves as storage means for the balls B'. The package construction 20' has suitable closures, each designated by the reference numeral 27', provided at opposite ends thereof to define a unitary construction or package which includes tee 23', bat 24', and balls B' which are held together as a unit for storage, transportation, display, and sale. The end closures 27' may be made in any suitable manner and may be the type of plastic closure commonly used as a reclosure lid for coffe cans. In particular, each end closure 27' comprises a substantially planar central portion 28' and a peripheral annular flange 29' extending transverse the planar portion 28'. The flange 29' is particularly adapted to snap fit around its associated member 21' or base mans 22' and thereby hold its closure 27' firmly in position.

In the package construction 20', the maximum outside diameter of the bat 24' and the inside diameter of the tubular tee member 21' are correlated so that the bat 24' may be easily inserted within and removed from the tubular member 21'. Further, the bat 24' may be a lightweight tubular or solid bat made of a plastic material or such bat may be made of fiberglass, metal, wood, or any other suitable material. In addition, it will be appreciated that the balls B' may be regulation baseballs, regulation softballs, sponge rubber balls, plastic balls, or balls made of other suitable materials; also, such balls B' may be thin-walled hollow balls with or without openings in their thin walls.

The tee 23' comprised of portion 21' and base means or base 22' of this example is shown as a single piece construction having a substantially frustoconical tubular transition portion 30' therebetween; however, it will be appreciated that the component portion 21' and base means or base 22' may be suitably fixed together using other techniques and transition means and for that matter the base 22' need not necessarily be of a larger outside diameter than the outside diameter of the tee member 21' as shown.

Other exemplary embodiments of package construction of this invention are illustrated in FIGS. 9, 11, 13, 14, 15, 16, 17, and 18. The package construction illustrated in FIGS. 8, 11, 12, 14, 15, 16, 17, and 18, are similar to the package construction 20'; therefore, such package constructions will be designated by the reference numerals 20A', 20B', 20C', 20D', 20E', 20F', 20G', and 20H' respectively and the representative parts of each package construction which are similar to corresponding parts of the package 20' will be deignated in the drawing by the same reference numeral as in the package construction 20' whether or not such component parts are mentioned in the specification followed by the associated letter designation either A', B', C', D', E', F', G', or H' and not described again in detail. Only these component parts of each package construction which are substantially different from corresponding parts of the package 20' will be designated by a new reference numeral also followed by the associated letter designation and described in detail.

The package 20A' is comprised of a tee 23A' defined by a base means or base 22A' which is made as separate part from the transparent tee member 21A'. The base may be made of any suiable material, but is preferably made of an elastomeric material which may be transparent.

The tee member 21A' is received in telescoped relation within a reduced diameter tubular portions 31A' adjoining the base 22A' and the member 21A' may be adjustably positioned and frictionally held so that its top annular ball-supporting surface may be arranged at an infinite number of vertical positions to thereby support a ball B' thereon in any desired vertical position for easier hitting as determined by the height of the batter using the tee 23A'. Except for this modification, it will be seen that a plurality of three balls B' are also carried within the base 22B' and a bat 24A' is arranged in telescoped relation within the transparent tee member 21A' with closure members 27A' being provided at opposite ends of the package construction 21'.

Figure 10:
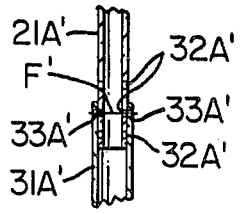
FIG. 10 is a fragmentary cross sectional view illustrating modified means for adjusting the vertical height of the ball tee member and its base means.
Figure 11:
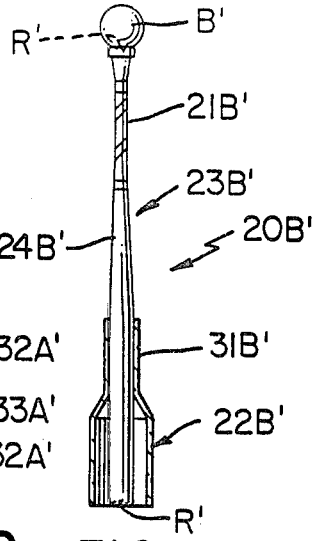
FIG. 11 is a view similar to FIG. 9 illustrating another exemplary embodiment of a package construction defined by base means and a ball bat which serves as a ball tee member and showing a ball supported at one end of the ball bat.

It may be desirable in some applications of this invention to avoid the necessity of providing controlled tolerances of the outside diameter of the tubular tee member 21A' and the inside diameter of the right circular cylindrical portion 31A' of the base means or base 22A'. For example, the outside diameter of the member 21A' may be substantially smaller than the inside diameter of the portion 31A' and as shown in FIG. 10. In order to provide adjustability of the vertical height of the tubular ball tee member 21A', a plurality of sets of diametrically aligned openings 32A' may be provided in the tubular member 21A' and corresponding diametrically arranged sets of openings 33A' may be provided in the cylindrical portion 31A' of the base 22A' so that a suitable fastener such as a fastening string F' may be inserted through suitably aligned sets of openings 32A' and 33A' once the member 21A' has been positioned or adjusted vertically at the position at which a ball B' may be supported on its top annular surface.

The package 20B' illustrated in FIG. 1 is comprised of a ball tee 23B' defined by a base means or base 22B' also having a reduced diameter right circular cylindrical tubular portion 31B' similar to the portion 31A' of base 22A' and the tee member of this example is in the form of a ball bat 24B'. A ball B' comprising the package 20B' is detachably fastened as by adhesive tape, or the like (not shown) against the top surface of the knob defining the terminal end of the handle portion of the hot 24B'. The bat 24B' which in reality defines the ball tee member 21B' in this embodiment is frictionally held within tubular portion 31B' and the complete package construction 20B' is comprised of base means 22B', bat 24B' which defines ball tee member 21B', and a ball B' suitably attached in position to either member 22B' or bat 24B'.

To assure that a ball B' may be supported on the knob of the handle portion of the ball bat 24B', a substantially inwardly concave recess B' may be defined in the bat so that the ball B' may rest therein in a secure manner. It will also be appreciated that the inside diameter of the tubular right circular cylindrical portion 31B' is closely correlated with the outside diameter of the bat so that the bat may be snugly fit and inserted within the right circular cylindrical portion 31B' and frictionally held thereby to adjustably vertically position such bat and thereby vertically position the ball at an infinite number of positions above the base means or base 22B'.

Another inwardly concave recess designated by the reference numeral R' may be provided in the terminal end of the hitting end portion of the bat 24B' and the base 22B' suitably modified to receive and support the handle end portion of such bat whereby a ball B' may be supported in the inwardly concave recess R' in the terminal end of such hitting end portion so that it may be hit by another ball bat.

If desired, a plurality of one or more balls B' may be placed within the lower portion of the base 22B' and combined at one end by a closure similar to the closure 27' and at the opposite end by the hitting end portion of a bat 24B' frictionally engaging the inside surface of right circular cylindrical portion 31B' to define a modified package 20B'.

Figure 12:
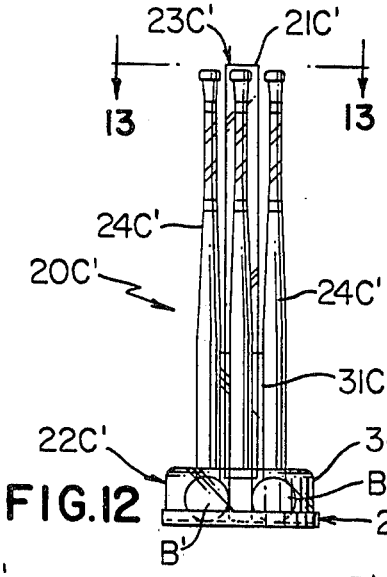
FIG. 12 is a view similar to FIG. 8 illustrating another exemplary embodiment of the package construction which is shown without a means normally used to overwrap the components thereof to define a unitary package.

The package construction 20C' illustrated in FIG. 12 is comprised of a ball tee 23C' defined by a base means or base 22C' made of a transparent elastomeric material and having a right circular cylindrical portion 31C' defined as an integral part thereof. The tubular member 21C' is telescoped within the inside diameter of the right circular cylindrical portion 31C' and is adapted to be frictionally held at an infinite number of vertical positions in a similar manner as the member 21A' of tee 20A'; and a bat 24C' is received in telescoped relation within member 21C'. However, it will be appreciated that the tee 23C' instead of being made of two relatively vertically slidable parts 21C' and 22C' may be made as a single part having a fixed vertical height yet being defined by component portions 21C' and 22C'.

Figure 13:
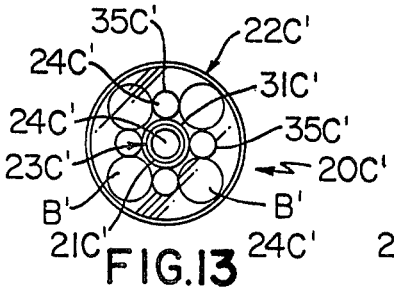
FIG. 13 is a view taken on the line 13-13 of FIG. 12.

The base 22C' of tee 23C' is comparatively large in diameter and has a roughly hat-shaped bottom portion 34C' which is provided with a plurality of four openings 35C', see FIG. 13, each adapted to receive a bat 24C' therethrough. Thus, when the ball tee 23C' is not in use as a tee for hitting a ball therefrom, it may be used as a ball bat stand for a plurality of bats, shown in this example as a plurality of four bats 24C'.

The package 20C' is unique because it has a multifunction tee 23C' made of a transparent material which may be used to contain balls B', may be used as a bat stand, or may be used as a ball supporting tee. In addition to the multifunction tee 23C', the package 20C' also has a plurality of four balls B' supported within the hat-shaped section 34C' of its base 23C', and a plurality of four bats 24C' arranged through openings 35C' with a fifth bat 24C' telescoped within tubular member 21C'. The balls B' and bats 24C' are prevented from falling through the base 22C' by the use of a closure 27C' and the top portion of the package construction 20C' is also provided with suitable means for holding the package construction together as a unit. Preferably, the overall package 20C' is suitably overwrapped with a suitable material such as a transparent plastic film which may be heat shrunk in position thereagainst in the usual shown manner.

Figure 14:
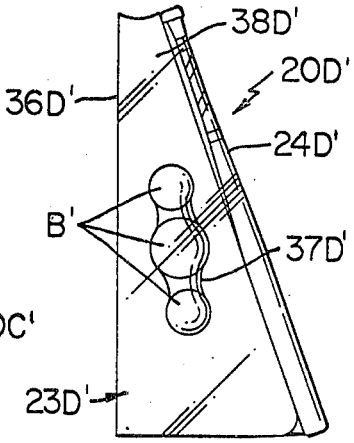
FIG. 14 is another exemplary embodiment of a package construction of this invention.

The package 20D' shown in FIG. 14 utilizes ball tee 23D' made either of a single piece of flat material and hingedly fastened along an edge 36D' thereof or of a pair of hingedly fastened flat pieces. The ball tee 23D' is of the type described in more detail in applicants' copending patent application Ser. No. 320, 280, filed Jan. 2, 1973, now U.S. Pat. No. 3,863,920 and reference may be made to such patent application for a more detailed understanding of such ball tee. The package construction 20D' has a plurality of three balls B', the center one of which is shown as having a larger diameter than the other two. The balls B' of the package construction are supported in opening means 37D' provided in the tee 23D' and are arranged therewithin in substantially nested relation and a ball bat 24D' is supported along one side of the tee 23D'. The opening means 37D' of tee 23D' also serves to reduce the area of the tee 23D' to prevent it from being blown over by the wind. The entire tee 23D', balls B', and bat 24D' are packaged together as a unitary construction with a suitable transparent plastic film 38D' which is heat shrunk therearound in a known manner.

Figure 15:
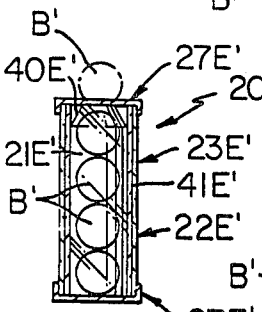
FIG. 15 is another exemplary embodiment of a package construction of this invention and defined by a ball tee member comprised of a plurality of telescoped sections and a plurality of balls.

The package construction or package 20E', illustrated in FIG. 15 is comprised of a plurality of telescoping sections, the outer one of which is designated by the reference numeral 22E' and defines the base means or base for the tee 23E' defined thereby. The ball tee member may be considered as the inner member 21E' and has a frustoconical tapering portion 40E' for supporting a ball B' thereon and the tee 23E' has a central telescoping member 41E' interconnecting portions 21E' and 22E'. The compact package 20E' is defined by portions 22E', 21E', and 41E' and has a plurality of four balls B' supported therewithin and such package has end closure members 27E' fastened at opposite ends thereof against outer member 22E'. The members 22E', 21E', and 41E' are readily pulled apart after removing end closures 27E' and the balls B' removed to define the ball supporting tee 23E' which is adapted to support a ball B', shown by dotted lines, thereon and in the manner described previously. The tolerances of members 22E', 21E', and 41E' are such that once such members are expanded they are self held by friction in their expanded position.

Figure 16:
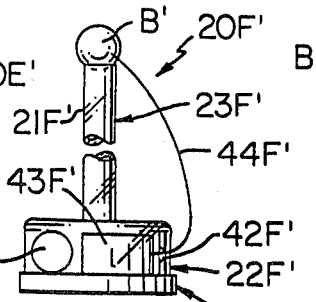
FIG. 16 is another exemplary embodiment of a package construction of this invention which has automatic ball return means.

The package 20F' illustrated in FIG. 16 is comprised of a tee 23F' having a base 22F' and a ball tee supporting member 21F' which are made as a single integral part and of a transparent material. The base portion 22F' is particularly adapted to support at least one ball B' therewithin and has a closure member 27F' for sealing the bottom surface of the base 22F' in position. In addition, it will be seen that an opening 42F' is provided in the base 22F' and a reel-like retract device 43F' is fixed in position within the base 22F'. A suitable string 44F' similar to a fishing line extends from the device 43F' through opening 42F' and is attached to a ball B' supported on top of the tee member 21F'. The device 43F' is of type which allows the ball B' to be struck from the tee 23F' and the device 43F' allows the string 44F' to remain attached thereto as the ball travels from the tee 23C'. Once the ball B' comes to a halt, suitble means preferably storge battery operated, provided within the device 43F' is automatically energized to automatically rewind the string 44F' to retract the ball B' so that it is reeled against the outside surface of the base 22F' whereupon the operation may be repeated.

Figure 17:
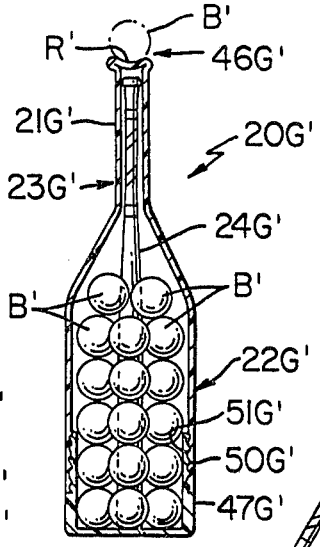
FIG. 17 is another exemplary embodiment of a package construction of this invention in which the ball tee member is a self supporting ball bat.
Figure 18:
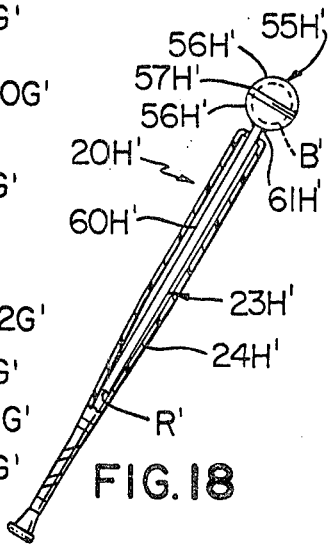
FIG. 18 is another exemplary embodiment of a package construction of this invention wherein the ball tee member is telescoped within a tubular bat.

The package construction 20G' of FIG. 17 is comprised of a bat made of a lightweight plastic material which is used to define the ball tee 23G' and the lower portion of the hitting portion of the bat or tee member 23G' defines the base 22G' while the handle portion thereof defines an integral tee member designated by the reference numeral 21G'. The comparatively large diameter hitting portion of the large or fat bat which is described as a tee member 23G' may contain a large number of balls B' therein and preferably has a ball bat 24G' of roughly regulation size or smaller also supported therewithin. A recess R' may also be provided in the tee member portion 21G' of the bat member 23G' for supporting a ball B' thereon as illustrated at 46G'. In addition, the lower portion of the tee 23G', i.e., the very large diameter hitting portion of the bat-tee 23G', may have a lower terminal end portion designated by the reference numeral 47G' provided with external threads 50G' which threadedly engage cooperating internal threads 51G' in the main tubular portion of the member 23G'. The threads 50G' and 51G' may be used to adjust the vertical position of a ball which is to be supported on the recess R' of the handle end portion of the member 23G'.

Thus, the package construction 20G' has two ball bats provided as a part thereof with one ball bat being a very lightweight large plastic tee bat 23G' which may be used as an adjustable tee or a large bat. The other ball bat 24G' is supported within the large diameter ball bat and the package 20G' also includes a plurality of balls B'.

The package construction 20H' is comprised of a tubular bat 24H' which has at least a portion of a tee means 23H' telescoped therewithin. In particular, the tee means comprises a hollow spherical member 55H' which may be the size of a regulation softball and which is defined by two hemispherical parts 56H' detachably fastened together on a large diameter at 57H' by either threads or a snap fitting arrangement. A tube or rod 60H' is fixed to one of the hemispherical parts as shown at 61H' and extends perpendicular to a plane adjoining the base of part 56H' against which member 60H' is attached.

The member 55H' may carry a ball B' of the package 20H' therewithin and such package is completed by inserting member 60H' within a bat 24H' and suitably fastening member 55H' against bat 24H'. The tee-defining member 60H' has a recess R' at its terminal end for supporting a ball thereon and in applications where member 60H' is tubular the recess R' is inherently defined by the annular surface at the terminal end of member 60H'.

While the various embodiments of this invention have been described and illustrated as being formed of continuous wall material, it is to be understood that all or part of each ball tee member and/or its associated base means could be formed of perforated wall means to not only reduce the weight and material thereof, but to also reduce its wind resistance and permit any device stored therein to be readily viewable therethrough whereby the material of the wall means could be other than transparent, if desired.

Figures 19, 20, 21, 22, 23, 24, 25:
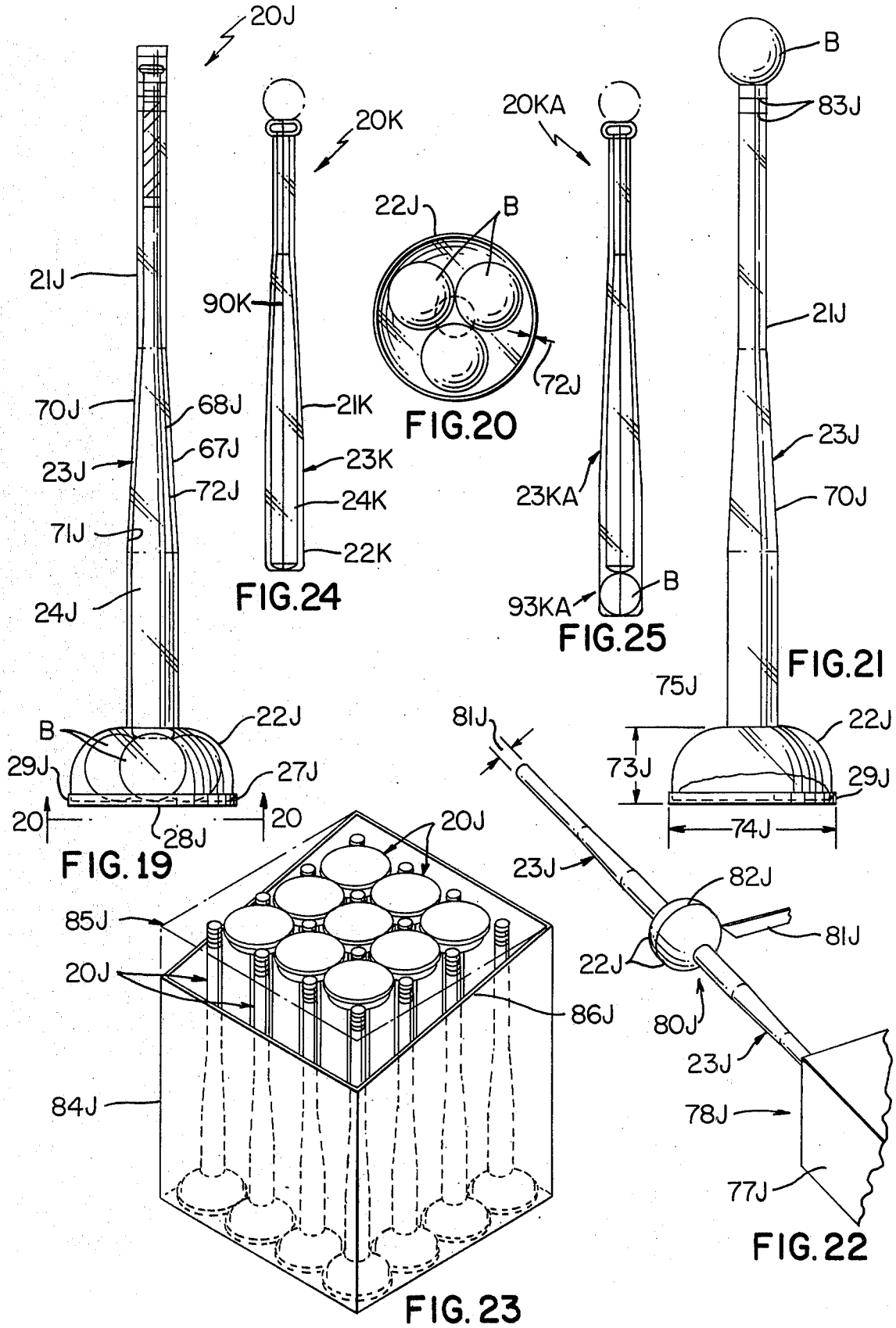

Reference is now made to FIG. 19 of the drawing which illustrates another exemplary embodiment of a package contruction of this invention and method of making same which is designated generally by the reference numeral 20J. The package construction 20J comprises a ball tee member 21J which is adapted to have a ball B hit off of same by a ball bat, or the like, and the ball tee member 21J has base means in the form of a substantially hat-shaped base 22J defined as an integral part thereof to define what would be referred to as a ball tee and designated generally by the reference numeral 23J. The ball tee member or portion 21J of tee 23J and its base 22J are shown, in this example, as being made of a transparent material which is preferably a transparent elastomeric material such as plastic and member 21J is particularly adapted to be struck repeatedly by a ball bat, or the like, without substantial damage thereto whereby the tee 23J may be used for extended periods of time for both hitting practice either indoors or outdoors as well as for actual play of the game of tee which is rapidly increasing in popularity.

The package construction 20J has a ball bat 35J telescoped within its tee member 21J and a plurality of balls B are provided and carried within the base 22 so that the bottom points of such balls are substantially coplanar and the base 22J also serves as storage means for the balls B. The package construction 20J has a suitable closure 27J provided at the base thereof to define a unitary construction or package which includes tee 23J, bat 24J, and balls B which are held together as a unit for storage, transportation, display, and sale. The end closure 27J may be made in any suitable manner and may be the type of plastic closure commonly used as a reclosure lid for coffee cans as explained in connection with the closure 27′ of package construction 20′. The end closure 27J comprises a substantially planar central portion 28J and a peripheral annular flange 29J extending transverse the planar portion 28J. The flange 29J is particularly adapted to snap fit around its associated member 21J or base means 22J thereof and thereby hold its closure 27J firmly in position.

In the package construction 20J, the maximum outside diameter of the bat 24J and the inside diameter of the tubular tee member 21J are correlated so that the bat 24J may be easily inserted within and removed from the tubular member 21J. Further, the bat 24J may be a lightweight tubular or solid bat made of a plastic material or such bat may be made of fiberglass, metal, wood, or any other suitable material. In addition, it will be appreciated that the balls B may be regulation baseballs, regulation softballs, sponge rubber balls, plastic balls, or balls made of other suitable materials; also, such balls B may be thin-walled hollow balls with or without openings in their thin walls.

The tee 23J comprised of portion 21J and base means or base 22J of this example is shown as a single piece construction and the portion 23J has a substantially frustoconical tubular transition portion 70J which has an inside surface 71J which is particularly adapted to be engaged by the transition portion 72J whereby the bat is confined against axial movement out of the top ball supporting end of portion 21J. The balls B are confined between the bat 24J and closure 27J.

The tee 23J comprised of upper portion 21J and base means or base 22J of this example is shown as a single-piece construction, although it may be made of a plurality of pieces, and by making the tee 23J with a substantially frustoconical tubular transition portion 67J which corresponds to the configuration of the transition portion 68J of the ball bat 24J, the amount of material required to make the tee 23J is decreased. In addition, with the transition portion 68J the ball bat 24J is first inserted from the bottom end of the tee 23J and then the balls B are placed therein whereupon the closure 27J is installed and it is not necessary with the tee 23J to provide a closure at the top end or the top of the tee 23J and in essence the only closure that is required is the closure 27J.

It is a simple matter to use the tee 23J of the package construction 20J by first removing the closure 27J in the usual manner in which a plastic coffee can type closure would be removed from a coffee can whereupon the balls B and bat 24J may be easily removed therefrom. The tee is ready for use by placing such tee on a grassy surface, a dirt surface, a concrete surface, a floor or any type, or a flat surface of the type usually provided on the usual home plate of a regulation baseball or softball diamond. In those instances where the tee 23J is used on a grassy surface, it will be appreciated that it has a comparatively thin wall as indicated at 72J and such wall has a comparatively large height 73J between the bottom edge of the base 22J and the inside surface of the top of that hat-shaped base 22J allows easy insertion in soft soil or nesting of grass on opposite sides of the wall 72J to support the lightweight tee 23J in an upright manner. It must be appreciated that it is generally preferable that the tee be easily knocked over in the event that a batter hits the tee to minimize or effectively eliminate any stinging sensation transmitted through the bat to a batter's hands. However, the tee 23J of the package construction 20J may have comparatively wide base defined by a comparatively large diameter 74J as illustrated in FIG. 20 whereby a substantial stability is provided for such tee and depending upon the intended use of the package construction 20J, the diameter 74J of the base 22J may be such that it will receive a plurality of three regulation or offical size baseballs or three regulation or official size softballs, for example, whereby the criteria for the dimensions of such a base would be determined by the size of these balls, which is well known in the art.

It will also be appreciated that use of the closure member 27J allows ballast means 75J to be suitably placed or poured into the tee 23J and such ballast means 75J may be in the form of sand, dirt, or the like, which is held in position by the closure 27J. In addition, such ballast means may be in the form of water, if desired.

The tee 23J may be made of any suitable elastomeric material such as a synthetic plastic material, for example, and preferably utilizing well known and commonly used plastic blow molding equipment 77J and a fragmentary portion of such equipment is illustrated at 78J in FIG. 22. The blow molding may be achieved in a continuous process providing a plurality of interconnected tees each having its portions 21J and base 22J as a single unitary structure. The construction arrangement, and operation of the blow molding equipment 77J is preferably such that a structure essentially as illustrated at 80J exits the apparatus 77J whereupon suitable knife means in the form of a knife 81J, of any construction known in the art, is used to sever the continuous structure first at a small diameter portion 81J of such structure, corresponding to two adjoining top ends of portions 21J, and then at a large diameter portion 82J, corresponding to two adjoining bottom ends of bases 22J, to define individual tees 23J in a continuous uninterrupted process.

Obviously, the tee 23J may be made by other well known processes other than continuous blow molding, including injection molding, molding of each tee 23J in a separate mold, and the like.

The tee 23J of the package construction 20J may also be provided with suitable parallel marks 83J on the under portion thereof to enable customizing the tee 23J to individual heights as desired by different ball players of different heights. Further, it will be appreciated that the material used to make the tee 23J is generally so inexpensive that a ball player may have a plurality of package construction 20 and tees 23J cut to various heights to support the ball at different locations in the strike zone, which for a regulation baseball and softball is defined by the zone between the batter's knees and armpits. In addition, and as in the case of previous embodiments disclosed in this application, the tee 23J may be provided with a tubular component, not shown, telescoped either within or outside of the upper part of the portion 21J to provide adjustability for the location of the ball B at an infinite number of positions without cutting along the marks 83J.

The package construction 20J lends itself to packaging in a carton such as the carton 84J for shipping to a retailer, and the carton 84J may be of any suitable known construction such as cardboard, corrugated board, or the like. The carton 84J is ordinarily in the shape of a parrallelepiped having an upper portion 85J, indicated by dot-dash lines with such upper 85J being severed away along the line 86J to define an opening in the top portion of the carton 84J with such opening providing easy visibility of the package constructions 20J for display purposes.

Another exemplary embodiment of the package construction of this invention is illustrated in FIG. 24 of the drawing and is designated by the reference numeral 20K. The package construction 20K comprises a ball tee member or portion 21K, which is adapted to have a ball hit off of same by a ball bat or the like; and, the ball tee member or portion 21K has integral base means 22K whereby portion 21K and 22K define a tee 23K of construction 20K. The tee 23K with its integral base 22K are also shown in this example as being made of a transparent material and it will be seen that the tee 23K had a longitudinal slit 90K extending the full length thereof allowing the tee 23K to be spread apart whereupon a ball bat 24K comprising the package construction 20K may be telescopically received within the tee 23K either by insertion from an end thereof or by insertion from the opening defined by spreading along the split or slit line 90K.

The tee 23K of the packing construction 20K is in essence a dual purpose member; namely, a mail package or mailing tube and a tee, whereby the ball bat 24K is protected during shipment and tee 23K is a completely useable component. In addition, the material selected to define the tee 23K is such that the natural resilience of the material will hold the tee 23K snap fitted around the ball bat 24K without the need of additional material or it will be appreciated that shipping labels or suitable tape may be used to hold the tee 23K around the bat 24K. In general, the natural resiliency of the elastomeric transparent material used to define tee 23K together with tape may be used to hold the bat 24K inside. The natural resilience of the tee 23K is sufficient to hold the tee 23K in a tubular configuration to support a ball thereon for hitting off of such tee 23K by a bat; and, such a ball is shown by dot-dash lines at 91K in FIG. 24.

Another exemplary embodiment of the package construction of this invention and method of making same is illustrated in FIG. 25 and the package construction illustrated in FIG. 25 is substantially identical to the package construction illustrated in FIG. 24 and therefore will be designated generally by the reference numeral 20KA and component parts thereof similar to parts of the package construction 20K will be designated by the same reference numeral as in the package construction 20K also followed by the letter designation A whether or not such components are described in detail.

The main difference between the package contruction 20K and the package construction 20KA of FIG. 25 is that the package construction 20KA has at least one ball B received in telescoped relation therewithin, as indicated at 93KA.

It will be appreciated that the package construction of this invention such as the package construction 20J, 20K, and 20KA, for example, as well as the other package constructions previously described, may be made utilizing the simple and unique method of this invention wherein simple steps are employed of providing the tubular baseball and soft ball type tee member, such as the tee member 23J, for example; providing a bat of a generally conventional baseball and soft ball type ball bat configuration for hitting the ball off of the tee member 23J; and telescopically disposing the tee member 23J and bat 24J together to provide a self-contained package construction thereof.

The step of telescopically disposing the tee member and the bat together may be achieved by the step of telescopically disposing at least part of the bat in the tubular tee member and in the package construction 20J the entire bat is shown disposed therewithin. Further, with the package construction 20J the tubular tee member 23J has opposed open ends and the step of telescopically disposing at least part of the bat in the tubular tee member 23J comprises the step of inserting the bat 24J in the tee member through one of the open ends thereof and in the case of the member 20J comprises inserting the bat through the end having the base portion 22J.

It will also be appreciated that the tubular tee member may be of the variety shown in FIG. 24 and designated 23K. The tubular tee member 23K has split 90K between opposed ends thereof and the step of telescopically disposing at least part of the bat 24K in the tubular tee member comprises the step of inserting said part of the bat, and in this example, the entire bat, into the tubular tee member through the circumferentially widened split 90K thereof. After the bat 24K is telescoped in position the tee member 23K snaps in position therearound and essentially as shown due to its natural resiliency.

It will also be appreciated that the step of telescoping at least part of the bat in the tubular member such as the tubular tee member 23J or 23K may comprise the step of causing frictional engagement between the telescoping parts to tend to hold the telescoping parts together in the self-contained package construction of same. Further, the packaging step may include the step of packaging at least one baseball or soft ball type ball with the telescoped tee member and bat as in the case of the balls B telescoped within the base of tee member 23J and the ball B telescoped within the tee member 23KA of tee 20KA of FIG. 25.

It will be also be appreciated that one or more balls B may be secured to the tee member and this is achieved by securing the ball at one end of the tee member by telescopically disposing the ball within the one tee member. Further, the step of forming the one end of the tee member as an enlarged base as shown in FIG. 19 comprises telescopically disposing a plurality of balls in the tee member by then securing such balls in position by suitable means which may be in the form of the closure 27C.

It is to be understood that all of the embodiments of the self-contained package construction of this invention previously described and illustrated can be mailed to the purchaser thereof with or without further packaging thereof as the tee member of each package construction of this invention itself provides protection for the base ball items packaged therein and can readily receive a suitable mailing or shipping label thereon so that the tee member is itself a mailing or shipping tube for the package construction whereby all of the mailed or shipped items of each package construction is a baseball playing or practicing component without any waste of packaging material being utilized solely for mailing or shipping purposes - a desirable feature for those concerned with our environmental problems.

While present exemplary embodiments of this invention, and methods of practicing the same, have been illustrated and described, it will be recognized that this invention may be otherwise variously embodied and practiced within the scope of the following claims.

What is claimed is:

1. A method of making of making a package construction comprising the steps of providing a tubular baseball and softball tee member having a chamber therein of a size to accommodate an entire bat of a conventional baseball or softball ballbat configuration and having a transition portion adapted to be engaged by the conventional transition portion of said bat, providing a bat of a generally conventional baseball or softball ballbat configuration for hitting a ball off of said tee member, and telescopically disposing the entire said bat into said chamber of said tee member to provide a self-contained package construction thereof.

2. A method as set forth in claim 1 wherein said step of providing said tee member comprises the step of forming said transition portion to be a substantially frusto-conical tubular transition portion.

3. A method as set forth in claim 1 wherein said tubular tee member has opposed open ends leading to said chamber thereof and wherein said step of telescopically disposing said bat in said chamber of said tubular tee member comprises the step of inserting said bat into said chamber of said tee member through one of said open ends thereof.

4. A method as set forth in claim 1 and including the step of forming said tubular tee member with a slit from one opposed end thereof to the other opposed end thereof, said step of telescopically disposing said bat in said chamber of said tubular member comprising the step of inserting said bat into said chamber of said tubular member through said slit thereof.

5. A method as set forth in claim 1 wherein said step of telescopically disposing said bat in said chamber of said tubular member comprises the step of causing frictional engagement between said telescoping parts to tend to hold said telescoping parts together in said self-contained package construction thereof.

6. A method as set forth in claim 1 and including the step of packaging at least one ball of a conventional baseball or softball ball configuration with said telescoped tee member and bat.

7. A method as set forth in claim 6 wherein said step of packaging at least one said ball comprises the step of securing said ball at one end of said tee member.

8. A method as set forth in claim 7 wherein said chamber of said tee member is also of a size to accommodate the entire said one ball along with said bat and wherein said step of securing said ball at one end of said tee member comprises the step of telescopically disposing the entire said ball in said chamber through one end of said tee member.

9. A method as set forth in claim 8 and including the step of forming said one end of said tee member as an enlarged base for supporting said tee member in an upright manner when said base is disposed on a supporting surface, said step of telescopically disposing said ball in said one end of said tee member comprising the step of telescopically disposing said ball in said enlarged base of said tee member.

10. A method as set forth in claim 9 wherein said step of forming said base of said tee member comprises the step of forming said base with a generally hat shaped configuration with the layer end thereof being open and the smaller end thereof being secured to said tee member, and including the step of closing said larger open end of said base with closure means after said ball has been disposed therein to hold said ball in said package construction.

* * * * *